US005174372A

United States Patent [19]

Potier et al.

[11] Patent Number: 5,174,372

[45] Date of Patent: Dec. 29, 1992

[54] HEAT EXCHANGER WITH A PLURALITY OF RANGES OF TUBES, IN PARTICULAR FOR A MOTOR VEHICLE

[75] Inventors: Michel Potier, Rambouillet; Philippe Le Gauyer, Paris, both of France

[73] Assignee: Valeo Thermique Moteur, Le Mesnil-Saint Denis, France

[21] Appl. No.: 853,209

[22] Filed: Mar. 18, 1992

[30] Foreign Application Priority Data

Mar. 20, 1991 [FR] France ..... 91 03411

[51] Int. Cl.[5] ..... F28F 9/04

[52] U.S. Cl. ..... 165/173; 165/178

[58] Field of Search ..... 165/83, 173, 175, 178

[56] References Cited

U.S. PATENT DOCUMENTS

| | | | |
|---|---|---|---|
| 2,655,181 | 10/1953 | Cooper | 133/87 |
| 3,627,039 | 12/1971 | Tiefenbacher | 165/158 |
| 3,907,032 | 9/1975 | DeGroote et al. . | |
| 4,175,308 | 11/1979 | Togashi | 165/178 X |
| 4,369,837 | 1/1983 | Moranne | 165/175 |
| 4,967,836 | 11/1990 | Nakamura | 165/173 |
| 5,107,925 | 4/1992 | Veigel | 165/173 |

FOREIGN PATENT DOCUMENTS

| | | |
|---|---|---|
| 3327335 | 7/1983 | Fed. Rep. of Germany . |
| 661464 | 11/1983 | Fed. Rep. of Germany . |
| 105893 | 6/1986 | Japan . |

*Primary Examiner*—Allen J. Flanigan

*Attorney, Agent, or Firm*—Morgan & Finnegan

[57] ABSTRACT

A heat exchanger comprises a bundle of parallel tubes disposed in rows and having respective end portions each of which is received in a collecting plate which is formed with holes. These holes may be bounded by lips. Each hole in the collecting plate receives the respective end portions of a plurality of adjacent tubes forming part of different ranges of the tube bundle. The pitch defined between two tubes in two adjacent rows may thus be reduced to a minimal value so as to optimize the performance of the heat exchanger, with a minimal width of the collecting plate.

7 Claims, 2 Drawing Sheets

HEAT EXCHANGER WITH A PLURALITY OF RANGES OF TUBES, IN PARTICULAR FOR A MOTOR VEHICLE

FIELD OF THE INVENTION

This invention relates to a heat exchanger of the kind comprising a bundle of parallel tubes disposed in rows and having respective end portions which are received in a collecting plate formed with holes, which may be bounded by lips.

BACKGROUND OF THE INVENTION

Such heat exchangers are used especially in motor vehicles having internal combustion engines, either for engine cooling purposes or for heating the cabin of the vehicle. An engine coolant fluid flows through the tubes in the bundle, while air circulates around the tubes. In certain cases, the tubes have a non-circular cross section, and in particular a flattened cross section, generally oval, eliptical or oblong, such as to reduce the loss of kinetic energy in the air flow passing through the heat exchanger and to optimise, to some extent, its thermal performance.

In the known heat exchangers of this type the same number of holes is provided in the collecting plate as there are tubes in the bundle, so that each tube end portion is received individually in a separate hole in the collecting plate and is sealingly joined to the collecting plate, and in particular to the above mentioned lip surrounding the relevant hole, if such a lip is provided. The collecting plate (which is also known as a perforated plate or tube sheet) is generally made in the form of a metallic plate in which are formed both the holes and the corresponding lips. The seal between each end portion of a tube and the corresponding lip of the collecting plate is then achieved either by interposing a compressible sealing element or by direct brazing, with the tube then being provided with a metallic coating having a low melting point. Since these heat exchangers comprise a plurality of rows of tubes, the collecting plate must also include a plurality of rows of holes which are separated from each other by a given pitch distance within any given row, and by a further given pitch distance as between one row of holes and the next. There thus exists between two consecutive holes in the collecting plate a thickness of material which, for reasons of mechanical strength of the collecting plate, must not be less than a certain minimum value. This minimum value is also essential in order to enable any lips to be formed around the holes in the collecting plate.

As a consequence, it has not hitherto been possible to realise the potential for optimisation of the dimensions of the tubes and their pitches, and therefore the optimisation also the thermal performance of the heat exchanger, for a given set of dimensions of collecting plate.

DISCUSSION OF THE INVENTION

A principal object of the invention is to overcome the above mentioned drawbacks. It therefore provides a heat exchanger of the kind comprising a bundle of parallel tubes disposed in ranges, the end portions of which are received in a collecting plate which is formed with holes, which may optionally be surrounded by lips.

According to the invention, each said hole of the collecting plate receives the respective end portions of a plurality of adjacent tubes, and in that a compressible sealing gasket is interposed between the said holes and the end portions of the tubes received in the holes. With this arrangement, the pitch between the tubes can be reduced to a minimal value. It is thus possible to optimise the heat exchanger performance, and with minimal dimensions of the collecting plate.

Since each hole in the collecting plate receives the end portions of several tubes, and since it may also be surrounded by a lip, the collecting plate is thus made more rigid, which leads to improved retention under compression of the end portions of the tubes.

Preferably, the sealing gasket comprises a spine portion which is adapted to be applied against the collecting plate, and which has compressible gasket lips corresponding to the holes in the collecting plate.

According to a preferred feature of the invention, each compressible gasket lip is adapted to be interposed between one hole of the collecting plate and the end portions of the tubes received in that hole, and each said compressible gasket lip defines an integral bridge portion extending between the respective ends of two adjacent tubes received in that hole. Each of the compressible gasket lips of the sealing gasket then ensures that there is adequate sealing between, firstly, the hole in the collecting plate and secondly, the end portions of the tubes received in that hole. Thus, in the case in which the tube bundle of the heat exchanger comprises two rows of tubes, each compressible lip of the gasket includes a single integral bridge portion. Where there are three ranges of tubes in the bundle, the compressible gasket lip includes two of these bridge portions.

The invention is applicable in particular to the case where the collecting plate has lips around the holes, but is not restricted to that case, preferably, each integral bridge portion of the compressible gasket lip is reinforced by a projection, the purpose of which is to limit displacement of the resilient material of which the gasket is made during introduction of the end portions of the tubes through it.

So as to limit further this displacement of material, the invention also preferably provides a comb-shaped bar embedded within the thickness of the sealing gasket, so as to reinforce the adjacent integral bridge portions.

Preferred embodiments of the invention will be described below, by way of example only and with reference to the accompanying drawings.

DESCRIPTION OF PREFERRED EMBODIMENTS OF THE INVENTION

Figure 1:
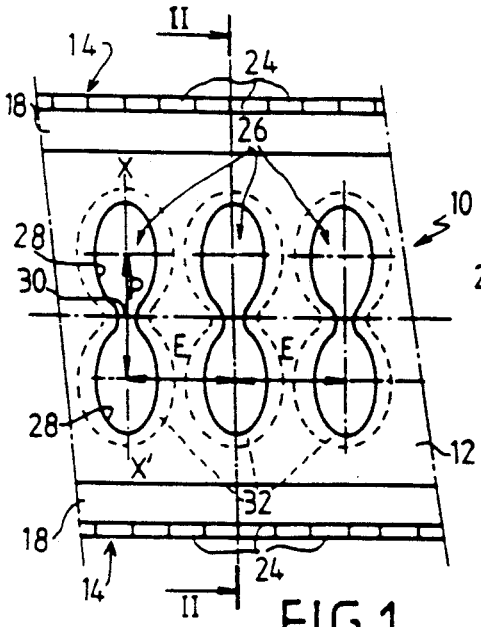
FIG. 1 is a top plan view of part of a collecting plate in a first embodiment of the invention.
Figure 2:
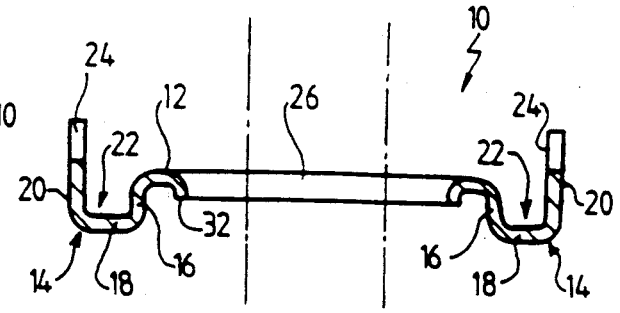
FIG. 2 is a view in cross section taken on the line II—II in FIG. 1.

Reference is first made to FIGS. 1 and 2, which show a collecting plate 10, otherwise referred to as a perforated plate or tube sheet which is of generally rectangular shape. The plate 10 consists mainly of a spine portion 12, generally rectangular in shape and preferably of a metallic material. The spine portion 12 has two parallel edges 14 corresponding to the two large sides of the rectangle, and two further parallel edges (not shown in the drawings), corresponding to the smaller sides of the rectangle. As seen in FIG. 2, each of the edges 14 comprises, first, a portion 16 which is joined at right angles to the spine portion 12, a portion 18 which is joined at right angles to the portion 16, and finally a portion 20 which is joined at right angles to the portion 18. The portions 16 and 18 of each edge 14 thus define a groove 22 which extends over the whole periphery of the plate 10, and serves a purpose which will be explained more clearly below. Each of the portions 20 is crenellated along its free edge, to define a series of lugs 24 which are able to be bent over for assembly of the collecting plate with a wall of a water box or manifold (not shown).

A row of oblong holes 26, identical to each other, are formed through the spine portion 12 of the collecting plate 10. Three of these holes 26 are shown in FIG. 1. Each hole 26 has an axis of symmetry XX' extending in the lengthwise direction and at right angles to the edges 14 of the collecting plate 10. Each of the holes 26 is defined by two identical oval sections 28, continuous with each other and intersecting in a throat 30. In this example, the two sections 28 are elliptical, with their respective major axes being aligned in the same direction as the axis XX'. The respective centres of the two elliptical sections 28 together define a pitch distance P between the two sections, which may be referred to as the section pitch. In addition, the distance between two adjacent holes 26 defines a further pitch distance E between one hole and the next, which may be referred to as the hole pitch and which is oriented at right angles to the section pitch P.

Each of the holes 26 is surrounded by a lip 32 having a profile corresponding to that of the two sections 28 including the throat 30. Each of the lips 32 projects from the spine portion 12 on the side opposite to the tabs 24.

It will be understood that each hole 26 is arranged to receive the respective ends of two tubes forming part of two adjacent rows in a tube bundle consisting of two rows of tubes. Within a single row, the tubes are separated one from another by the pitch distance E.

Figure 3:
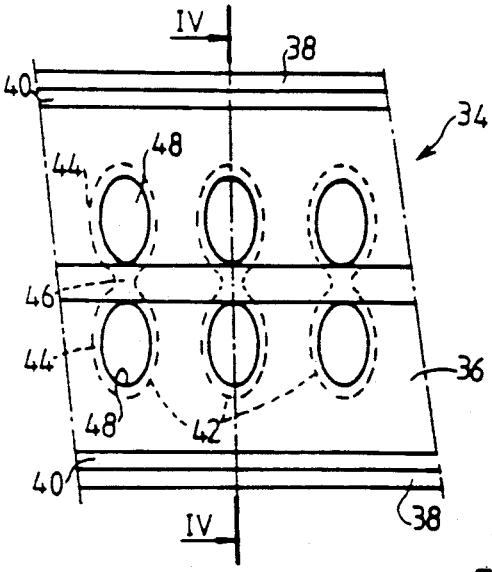
FIG. 3 is a top plan view of part of a sealing gasket for the collecting plate of FIGS. 1 and 2.
Figure 4:
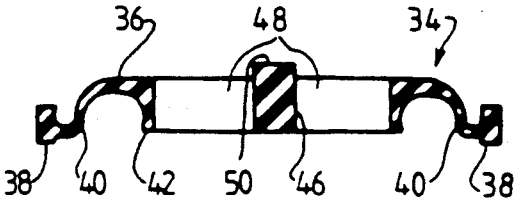
FIG. 4 is a view in cross section taken on the line IV—IV in FIG. 3.

Reference is now made to FIGS. 3 and 4, which show a sealing gasket 34 designed to be applied in overlying relationship on the collecting plate 10. The gasket 34 is made of a compressible elastomeric material, and comprises a spine portion 36 of generally rectangular shape corresponding to that of the spine portion 12 of the collecting plate 10. The spine portion 36 of the gasket is bounded by two longitudinal beads 38 corresponding to the two long sides of the rectangle, and two lateral beads (not shown) which correspond to the smaller sides of the rectangle. The beads 38 are joined to the spine portion 36 through an integral web 40. In this way, a bead is obtained which extends over the whole perimeter of the gasket and which is designed to be introduced into the groove 22 of the collecting plate 10.

The spine portion 36 of the gasket 34 is formed with compressible lips 42, the shape of each one of which is adapted to that of a hole 26 in the connecting plate, so that it can be introduced into the latter when the spine portion 36 of the gasket 34 is applied against the spine portion 12 of the collecting plate 10.

Each lip 42 thus has the general shape of a figure of eight, comprising two oval portions 44 which are joined together through an integral bridge portion 46. Thus, when a compressible lip 42 of the gasket 34 is introduced into a lip 32 of the collecting plate 10, the two portions 44 of the lip 42 engage respectively in the two sections 28 of the hole 26, with the integral bridge portion 46 lying in the throat 30. The spine portion 36 defines two apertures 48 within each compressible lip 42. Each of these apertures 48 is arranged to receive one end of a tube of the tube bundle, as will be seen below. As is shown more particularly in FIG. 4, each integral bridge portion 46 is reinforced by a projection 50 for limiting the movement of the material of the gasket during fitting of the tube bundle.

Figure 5:
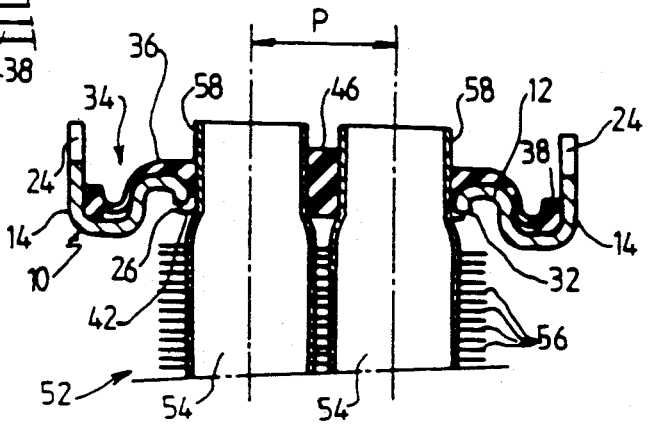
FIG. 5 is a transverse cross sectional view of part of a heat exchanger including a bundle of tubes assembled on the collecting plate of FIGS. 1 and 2 by means of the sealing gasket of FIGS. 3 and 4.

Reference is now made to FIG. 5, which shows a tube bundle 52 comprising two rows of tubes 54 of non-circular cross section. The tubes extend through a multiplicity of parallel cooling fins 56. The tubes 54 are separated one from another with a pitch distance E within one row (as in FIG. 1), and with a pitch p from one row to another as shown in FIG. 5. The tubes 54 have respective end portions 58 of non-circular cross section, spaced from each other at the same pitch as the tubes. The shape of the holes 26 in the collecting plate 10, and the shape of the compressible beads 42 and apertures 48 in the gasket 34, are adapted to match those of the end portions 58 of the tubes 54.

To fit the tube bundle 52 on to the collecting plate 10, the sealing gasket 34 is first fitted on to the collecting plate 10, after which the end portions 58 of the tubes are fitted through the apertures 48 in the gasket. The end portions 58 may be introduced into the apertures 48 and then be expanded outwardly so as to ensure the compression of the seal, in a known manner.

In a modification, it is possible to precompress each of the beads 42 with the aid of a suitable tool, and then to introduce each of the end portions 58, again in known manner.

After introduction of the end portions 58, the latter can be expanded over their whole periphery or over only part of their periphery, so as to prevent any accidental detachment from the collecting plate and from the bundle. Given that each integral portion 46 of the gasket 34 has a projection 50, movement of the material of the seal is limited during use of the precompressing tools or during the introduction of the tube end portions 58.

Figure 6:
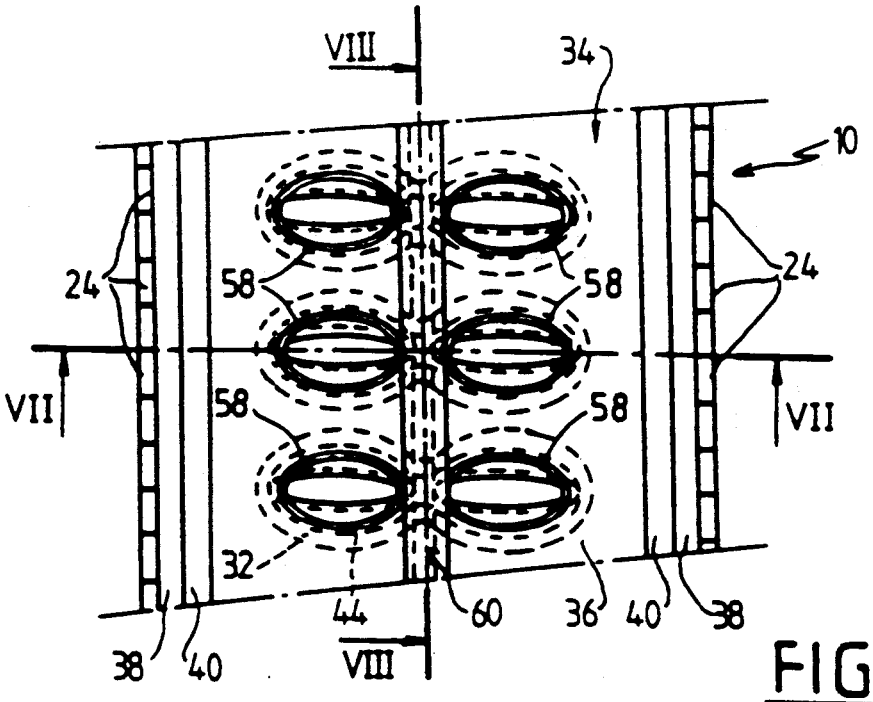
FIG. 6 is a top plan view of part of a collecting plate having a sealing gasket and receiving the ends of the tubes in a tube bundle of a heat exchanger in a second embodiment of the invention.
Figure 7:
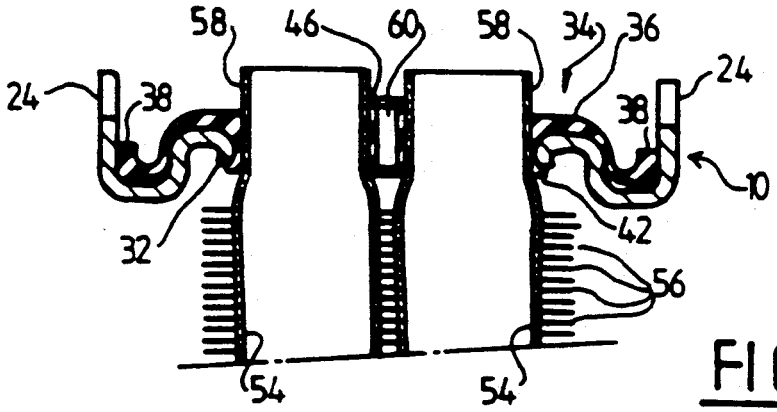
FIG. 7 is a view in cross section taken on the line VII—VII in FIG. 6.
Figure 8:
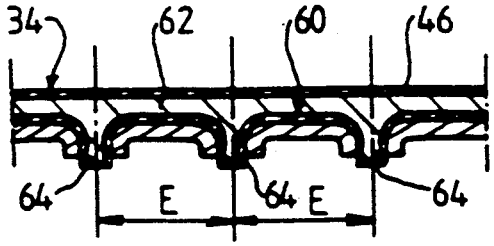
FIG. 8 is a view in cross section taken on the line VIII—VIII in FIG. 6.

In the embodiment shown in FIGS. 6 to 8, to which reference is now made, the sealing gasket 34 includes a comb-shaped bar portion 60 which is enclosed within the thickness of the gasket so as to reinforce the integral bridge portions 46 of each of the compressible beads 42. The bar 60 comprises a spine 62 which extends over the length of the gasket 34 and passes through the bridge portions 46, the spine 62 having a multiplicity of teeth 64 spaced apart by a distance corresponding to the pitch distance E. It will be understood that the presence of the bar 60, which is preferably in the form of a metallic bar moulded into the material of the gasket, offers resistance to movement of the material of the gasket while the bundle of tubes is being fitted.

In the embodiment previously described with reference to FIGS. 1 to 5, as well as in that shown in FIGS. 6 to 8, after assembly of the tube bundle on the collecting plate 10 the latter receives a wall (not shown) in the form of a hollow vessel having an open side such that the collecting plate bridges this open side so as to complete the construction of a water box or manifold. The water box wall is sealingly joined to the collecting box by bending over the tabs 24. Also in the various embodiments described above, the other end of the tube bundle is preferably provided with a similar collecting plate.

Although the invention has been described above with reference to tubes of non-circular cross section, it should be understood that it is equally applicable to tubes of circular cross section, the shape of the holes through the collecting plate being adapted accordingly.

It will also be understood that a heat exchanger can be made in accordance with the invention with a minimal pitch between two tubes in two adjacent ranges in the bundle. This leads to optimisation of performance for a minimal width of the collecting plate, while improving the retention of the tubes under compression.

What is claimed is:

1. A heat exchanger comprising a bundle of tubes and a collecting plate formed with a plurality of holes, each tube having an end portion and the tubes being arranged in a bundle divided into rows of tubes with the respective end portions of the tubes being received in the holes in the collecting plate, wherein each said hole in the collecting plate receives the respective end portions of a plurality of adjacent tubes of the bundle, the heat exchanger further including a compressible sealing gasket interposed between the said holes in the collecting plate and the end portions of the tubes received in the holes.

2. A heat exchanger according to claim 1, wherein the sealing gasket comprises a spine portion for engagement against the collecting plate and formed with compressible gasket lips corresponding to the said holes in the collecting plate.

3. A heat exchanger according to claim 1, wherein each compressible gasket lip is adapted to be interposed between a said hole of the collecting plate and the end portions of the tubes received in that hole, with each said compressible gasket lip defining an integral bridge portion extending between the respective end portions of two adjacent tubes received in the associated hole.

4. A heat exchanger according to claim 3, wherein each said integral bridge portion includes a reinforcing projection.

5. A heat exchanger according to claim 3, further including a comb shaped bar embedded within the thickness of the sealing gasket for reinforcing the integral bridge portions thereof.

6. A heat exchanger according to claim 1, wherein the tubes having their end portions engaged in a common said hole in the collecting plate are tubes of different rows of the tube bundle.

7. A heat exchanger according to claim 1, wherein each said hole in the collecting plate defines a lip.

* * * * *